US006330405B1

(12) United States Patent
Ishii et al.

(10) Patent No.: US 6,330,405 B1
(45) Date of Patent: Dec. 11, 2001

(54) IMAGE FORMING APPARATUS

(75) Inventors: Masayoshi Ishii; Hiroyuki Mabuchi; Koji Kato, all of Ibaraki (JP)

(73) Assignee: Hitachi Koki Company Limited, Tokyo (JP)

( * ) Notice: Subject to any disclaimer, the term of this patent is extended or adjusted under 35 U.S.C. 154(b) by 0 days.

(21) Appl. No.: 09/732,742

(22) Filed: Dec. 11, 2000

(30) Foreign Application Priority Data

Dec. 10, 1999 (JP) ..... 11-351233

(51) Int. Cl.[7] ..... G03G 15/00
(52) U.S. Cl. ..... 399/55; 399/56
(58) Field of Search ..... 399/55, 56, 223, 399/265, 270

(56) References Cited

U.S. PATENT DOCUMENTS 5,659,841 * 8/1997 Umeda et al. ..... 399/55
6,047,147 * 4/2000 Kato et al. ..... 399/55
6,243,543 * 6/2001 Nozawa ..... 399/55

* cited by examiner

*Primary Examiner*—Arthur T. Grimley
*Assistant Examiner*—Hoang Ngo
(74) *Attorney, Agent, or Firm*—Sughrue, Mion, Zinn, Macpeak & Seas, PLLC

(57) ABSTRACT

In an image forming apparatus, the developing unit includes two developing rollers whose rotational directions are different from each other, and a bias potential of the developing roller (first developing roller) located upstream in the rotational direction of the photosensitive member is selected to be a potential, which is in value between a bias potential of the developing roller (second developing roller) located downstream in the same direction and a background potential.

6 Claims, 7 Drawing Sheets

IMAGE FORMING APPARATUS

BACKGROUND OF THE INVENTION

1. Field of the Invention

The present invention relates to an electrophotographic image recording apparatus for visualizing an image by using toner, such as printers, facsimile machines and copying machines. More particularly, the invention relates to a developing method in a developing process for forming a toner image on a surface of a recording medium, and a recording apparatus using the method.

2. Description of the Related Art

The electrophotographic image recording apparatus uses a developing step and a fixing step. The developing step develops a latent electrostatic image into a toner image by supplying an image visualizing matter, called toner, to the latent electrostatic image. This latent image is formed on an image carrying member, called a photosensitive member, which rotates in one direction. The latent electrostatic image has an image portion having a predetermined potential Vr and a background portion having a predetermined potential V0. The fixing step fixes the thus formed toner image onto a recording medium.

A developing unit using a two-component developer consisting of toner and magnetic powder called carrier is frequently used in the developing unit for the electrophotographic system.

In the developing process, the developer is confined and agitated within the developing unit. The toner is charged through its friction with the carrier during the agitation. A method, called a bias developing method, is usually used for an image forming step of the developing process. A bias voltage Vb, which is in amplitude between the image portion potential Vr and the background portion potential Vo, is applied to a magnetic roller, called a developing roller, which is for transporting a developer to a location facing a latent electrostatic image on the photosensitive member surface of the developing unit. In forming an image, toner particles, charged under an electric field developed between the latent image formed on the photosensitive member surface and the developing roller, are separated from the developer and the separated ones migrate to the photosensitive member surface. A difference between the bias voltage Vb to the developing roller and the image portion potential Vr is called a developing potential difference. A difference between the bias voltage Vb and the background portion potential Vo is called a background potential difference.

If the developing potential difference is large, an electric field (referred to as a "developing electric field") for causing toner particles to migrate from the developing roller to the image portion on the photosensitive member is large, the developing performance is good. If the background potential difference is large, an electric field (referred to as a "cleaning electric field") for causing toner particles to migrate from the background portion on the on the photosensitive member to the developing roller is large, the amount of toner particles (referred to as "fog") attached to the background portion is reduced. Usually, those potentials Vr, Vb and Vo are selected in value so as to secure the developing performance high enough to obtain a preset image density, and to put the fog within a target level. With increase of the background potential difference, a phenomenon (referred to as "back-end bleach") in which the trailing end of the image as viewed in the rotational direction of the developing roller is insufficiently developed, and an image defect caused by scattering of carrier are likely to occur.

As the carrier particle diameter increases, a space filling rate of the developer in the developing portion is increased. As a result, the developing performance is improved to provide high quality images. Further, the surface area contributing to the friction charging of toner increases. Accordingly, the increase of the carrier particle diameter is also advantageous in that the charging stability of the developer is improved. However, with decrease of the carrier particle diameter, the carrier more easily scatters. To avoid this, the lower limit of the carrier particle diameter is determined within a range where the image defect by the carrier scattering does not occur.

There is a modification of the bias developing method for electrophotographic system. The modification follows. As known for long (see JP-A-48-37148, for example), a medium potential is provided which is in level between the potentials of the charging area and the discharging area on the photosensitive member. A first developing unit for carrying out a reverse developing is provided in the discharging area, and carries out the development by using first color toner. A second developing unit for subsequently carrying out a normal development is provided in the charging area, and carries out a development by using second color toner. Thus, the developing method of the modification carries out the development of two colors by one charging step and one light irradiation step (exposure step). In this developing method, no toner is attached, for development, to a medium potential area on the photosensitive member, which has a potential value which is between a bias voltage value of the first reverse developing unit and a bias voltage value of the second normal developing unit. A white image portion is formed in the medium potential area. Accordingly, the background portion of the white image, and two images by the first and second color image forming portions are formed. In the specification, the two-color developing method will be referred to as a potential-dividing developing method. The potential-dividing developing method is valid in principle if the first development is the normal development and the second development is the reverse development.

In the potential-dividing developing method, the following problem arises: a fringe of a certain color image in which no image should be present is developed with another color toner (this phenomenon will be referred to as a "fringe development").

A method to remove the fringe development has been proposed in JP-A-10-39573. In this method, auxiliary light is irradiated onto an area in which the fringe development will occur, whereby the reverse electric field occurring thereat is suppressed in magnitude (This method will be referred to as an "auxiliary exposure method").

Problems of the image forming apparatus using the conventional potential-dividing developing method will be described with reference to FIG. 6A. FIGS. 6A and 6B graphically represent a potential distribution and an electric field distribution with respect to positions on a photosensitive member surface after an exposure process is carried out. In the conventional image forming apparatus using the potential-dividing developing method, with respect to image portion potentials Vca and Vda having predetermined values, and the medium potential Vw having also a predetermined value, potential values Vb1 and Vb2 are selected such that a difference between Vw and Vb1 and a difference between Vw and Vb2 are relatively large in order to suppress the fringe development occurrence and to reduce the fog by increasing the background portion potential Vo. For this reason, the development potential differences (potential differences between the image portion potential Vca and Vb1 and between the image portion potential Vda and Vb2) are suppressed, and hence the developing electric field cannot be increased to be large. As a result, it is impossible to secure a sufficient developing capability.

A method to increase the developing capability, which is generally used, is a method by increasing the number of developing rollers. When the number of developing rollers is simply increased, in the image forming apparatus using the potential-dividing developing method, the following problem arises: a chance of the occurrence of the fringe development is increased, although the developing capability is increased

SUMMARY OF THE INVENTION

The present invention has been made in view of the above circumstances, and has an object of providing an image recording apparatus which can produce an image having a sufficient image density and less background fog, and are free from the back-end bleach and the image defect.

Another object of the present invention is to provide a two-color image recording apparatus which can produce an image having a sufficient image density and less background fog, and are free from the fringe phenomenon.

To solve the above problems, the developing unit includes two developing rollers whose rotational directions are different from each other, and a bias potential of the developing roller (first developing roller) located upstream in the rotational direction of the photosensitive member is selected to be a potential, which is in value between a bias potential of the developing roller (second developing roller) located downstream in the same direction and a background potential.

In the two-color image recording apparatus, to solve the above problems, the developing unit includes two developing rollers whose rotational directions are different from each other, and a bias potential of the developing roller (first developing roller) located upstream in the rotational direction of the photosensitive member is selected to be a potential, which is in value between a bias potential of the developing roller (second developing roller) located downstream in the same direction and a medium potential.

DETAILED DESCRIPTION OF THE PRESENT INVENTION

Figure 1:
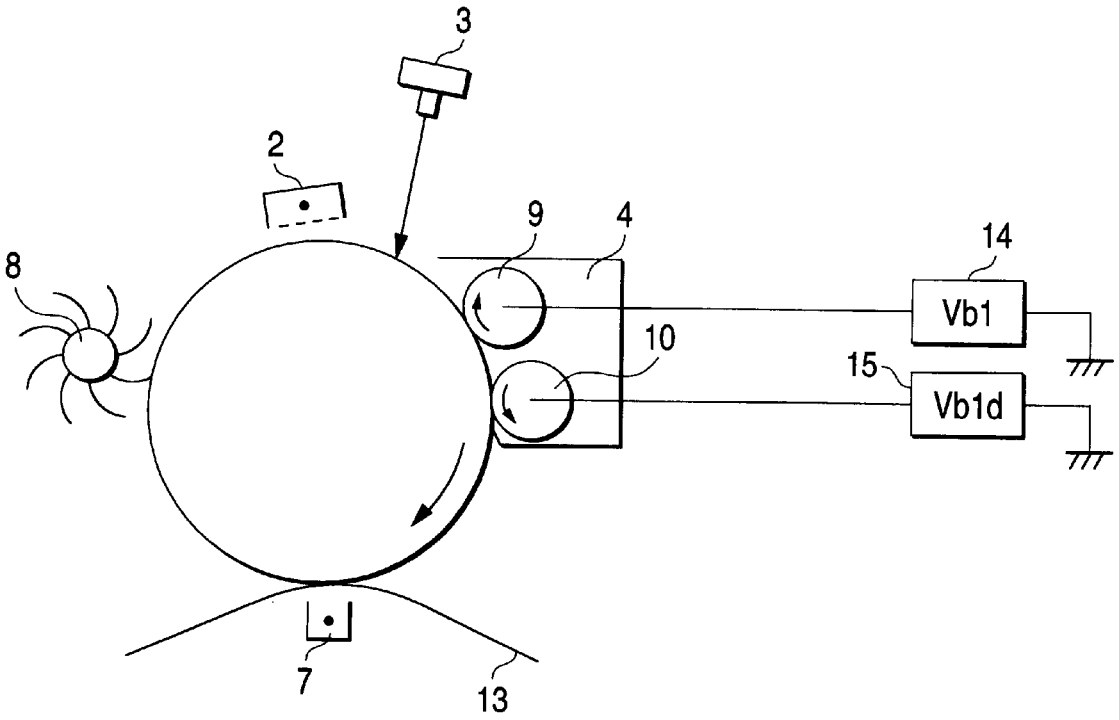
FIG. 1 is a diagram schematically showing an image recording apparatus according to the present invention.

A first embodiment of the present invention will be described with reference to FIGS. 1 to 3. FIG. 1 is a diagram schematically showing an image recording apparatus in which a developing roller (reverse turn developing roller), which rotates in the direction reverse to the rotational direction of a photosensitive member, is used for a first developing roller, and a developing roller (forward turn developing roller), which rotates in the same direction as the rotational direction of the photosensitive member, is used for a second developing roller. In the figure, reference numeral 1 is a photosensitive drum; 2 is a charger; 3 is an exposure unit; 4 is a developing unit; 7 is a transfer unit; 8 is a cleaner; 9 is a reverse turn developing roller; 10 is a forward turn developing roller; 13 is a recording medium; and 14 and 15 are power supplies.

Figure 2A:
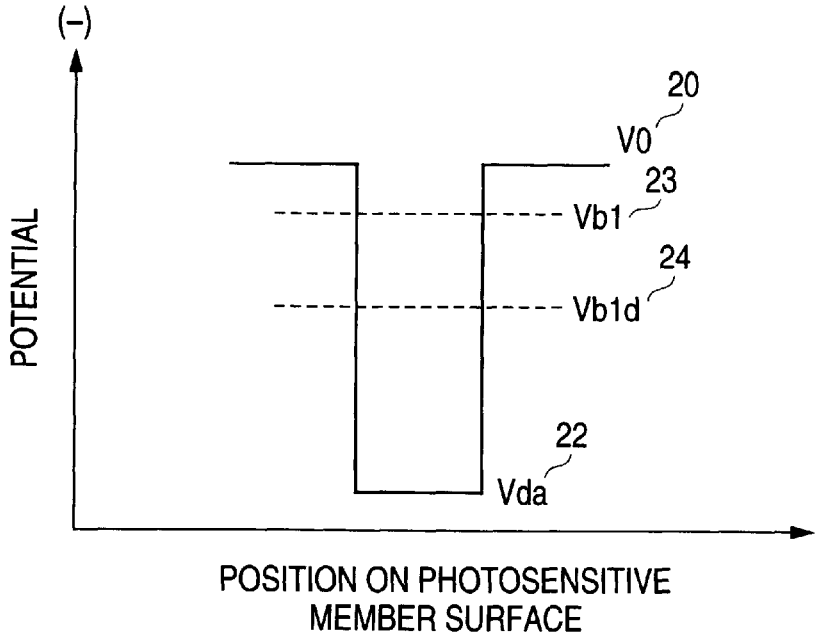
FIGS. 2A and 2B graphically represent a potential distribution on a photosensitive member and a model of development.
Figure 2B:
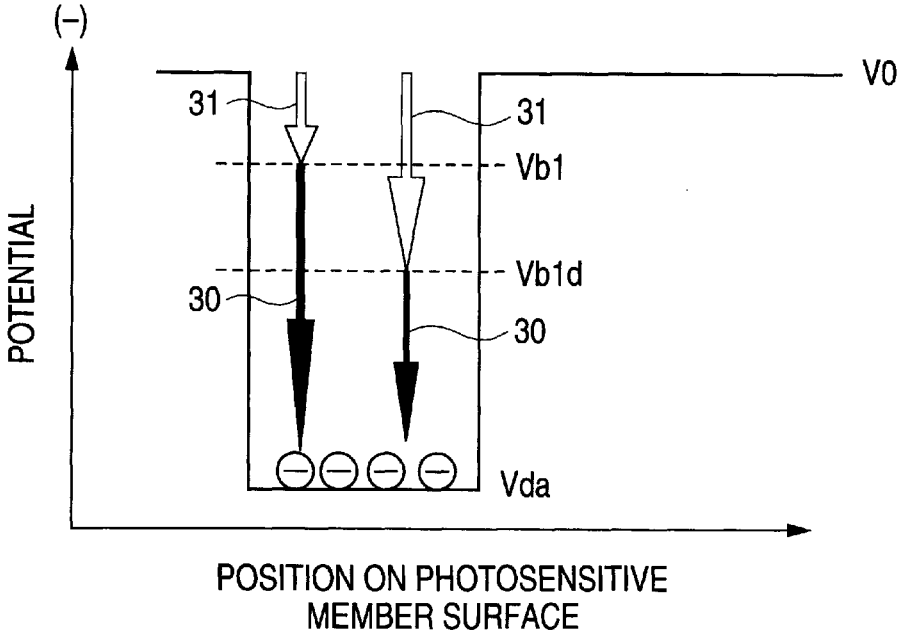

FIG. 2A shows a graph showing a relationship of a bias potential of the developing roller vs. a potential distribution on the photosensitive member. FIG. 2B is a diagram showing a model of an operation in the developing unit. In the figures, reference numeral 20 is a charging potential portion potential (background potential); 22 is a discharging potential portion potential (image potential); 23 is a bias voltage of the second developing roller; 24 is a bias voltage of the second developing roller; 30 is a developing electric field for causing negatively charged toner to migrate to an image portion for development; and 31 is a cleaning electric field for causing negatively charged toner to migrate from the Vo portion to the developing roller.

Mechanisms to cause the back-end bleach and the image defect by the carrier scattering will be described.

Figure 3:
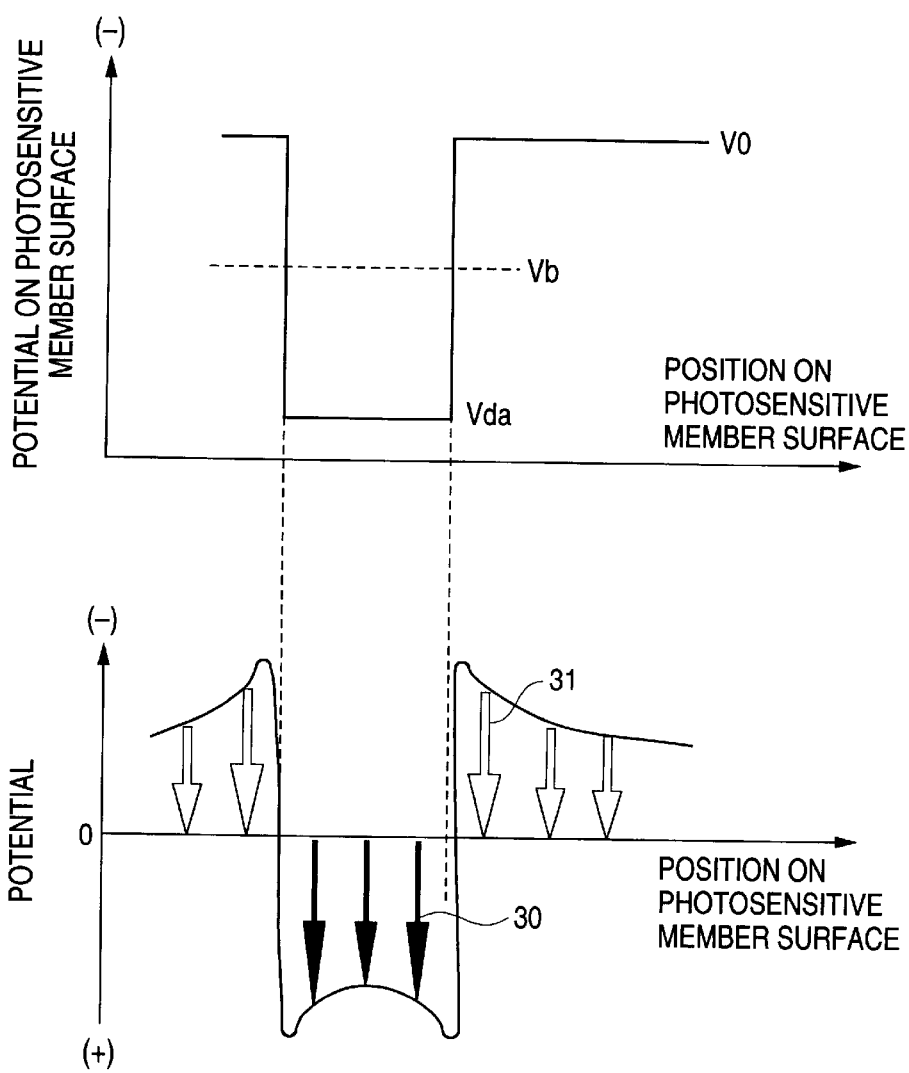
FIG. 3 graphically represents a potential distribution and an electric field distribution on a photosensitive member and a model of development.

FIG. 3 is a graph showing a relationship of an electric field acting on a photosensitive member surface and an electric field acting on a developing roller. When the developer lies on the charging potential portion (background potential), the electric field acts so as to move the toner of the developer apart from the photosensitive member (move the carrier whose charging polarity is opposite to that of the toner toward the photosensitive member). When the developer lies on the discharging potential portion (image potential), the electric field acts so as to move the toner of the developer toward the photosensitive member (move the carrier whose charging polarity is opposite to that of the toner apart from the photosensitive member). When the developer on the developing roller passes a boundary between the background potential and the image potential, it undergoes an abrupt change of the direction of the electric field.

At the back end of the image portion potential as viewed in the rotational direction of the developing roller, toner on the developing roller undergoes an abrupt direction change of the electric field from the direction in which the toner is moved apart from the photosensitive member to the direction in which it is moved to the photosensitive member. Accordingly, a time delay occurs in migrating of the toner from the developing roller to the image potential on the photosensitive member. As a result, the toner is not attached to the back end of the image as viewed in the rotational direction of the developing roller (viz., back-end bleach occurs). As the background potential difference increases, the direction of the electric field is more abruptly changed. Accordingly, the back-end bleach more easily occurs.

At the front end of the image portion as viewed in the rotational direction of the developing roller, the carrier on the developing roller undergoes an abrupt direction change of the electric field from the direction in which the carrier is moved apart from the photosensitive member to the direction in which the carrier is moved to the photosensitive member. The cleaning electric field at the peripheral edge of the image potential, as shown in FIG. 3, has been intensified by the edge effect. Accordingly, such a situation that carrier scattering easily occurs at the peripheral edge of the image, has been set up. At the front end of the image potential as viewed in the rotational direction of the developing roller, the developer on the developing roller has passed the image potential and has dropped the toner on the photosensitive member, and hence it is put in a state that a toner concentration of the developer is temporarily decreased. In this state, the carrier is easy to scatter (As the toner concentration become lower, the carrier more easily scatters). At the front end of the image as viewed in the rotational direction of the developing roller, the carrier is easy to escape from the magnetic attracting force by the developing roller and to move to the photosensitive member. Accordingly, the image defect by the carrier scattering tends to occur.

As the background potential difference is larger, or the difference between the image potential and the background potential is larger (the cleaning electric field around the image potential is more intensified by the edge effect), the cleaning electric field is larger, and hence the image defect by the carrier scattering is easier to occur.

In the image forming apparatus of the invention shown in FIG. 1, a negatively charged OPC is applied to the photosensitive drum 1, and a called reverse developing method in which the discharging potential portion is developed by using negatively charged toner is employed. In FIG. 1, the photosensitive drum 1 rotates clockwise. A surface of the photosensitive drum 1 is uniformly charged at potential Vo (−600V) by the first charger 2. The exposure unit 3 irradiates the charged surface of the photosensitive drum 1 with light to form a discharging potential portion Vda on the drum surface. Then, the first developing roller 9 develops a Vd portion on the photosensitive drum 1 with toner. The first developing roller 9 is potentially biased at a developing bias voltage Vb1 (about −550V) supplied from the power supply 14, and rotates in the direction reverse to the rotational direction of the photosensitive drum. Subsequently, it rotates in the same direction as the rotational direction of the photosensitive drum, which is applied with a developing bias voltage Vb1a (about 0300V) from the power supply 15. The second developing roller 10 applies negatively charged toner to the image portion potential Vda on the photosensitive drum 1 in a superimposing manner. Thereafter, the toner image thus formed on the photosensitive drum 1 is transferred onto a recording medium 13, e.g., paper, by the transfer unit 7, and the transferred one is fixed by a fixing unit (not shown). The photosensitive drum 1, after the transfer process, reaches the cleaner 8. In turn, the cleaner 8 removes residual toner on the drum surface. Here, the photosensitive drum 1 is ready for the next image forming process.

A phenomenon occurring in the developing portion will be described in detail with reference to FIG. 2B. When a latent electrostatic image formed on the photosensitive member passes a developing portion under the first developing roller (reverse turn developing roller) set at the developing bias voltage Vb1, a large developing electric field and a small cleaning electric field are developed since a difference between Vb1 and image portion potential Vda is large and a difference between Vb1 and the background portion potential Vo is small. Therefore, the developing performance is good and a high image density is obtained. However, a phenomenon, called fog, where the background portion potential attracts weakly charged toner frequently occurs. Since the cleaning electric field is small, the back-end bleach is hard to occur at the back end of the image as viewed in the developing roller of the developing roller, and the carrier scattering is also hard to occur at the front end of the image as viewed also in the same direction.

Subsequently, when the latent electrostatic image passes a developing portion by the second developing roller (forward turn developing roller) set at the developing bias potential Vb1d, a difference between developing bias potential Vb1d and the discharging potential portion Vda is small, anda difference between it and the background portion potential Vo is large. Accordingly, a small developing electric field and a large cleaning electric field are developed. In this case, the large cleaning electric field collects the weakly charged toner which was attached to the background portion potential under control of the first developing roller. Accordingly, the fog that is formed when the development based on the first developing roller is carried out is removed. At this time, a force causing the carrier to migrate from the developing roller to the photosensitive member relatively weakly acts on the first developing roller because the cleaning electric field is large. At the time of the development by the second developing roller, the image potential portion is already developed by the first developing roller, and the image potential has been increased by a potential corresponding to the amount of charge of the toner. Accordingly, a difference between the image potential and the background potential has been small. Accordingly, the intensifying of the cleaning electric field around the peripheral edge of the image potential portion, which is caused by the edge effect, has been reduced in degree. Further, the developing electric field is weaker than that by the first developing roller. Accordingly, a temporarily reduction of the toner concentration caused when the developer passes the fore end of the image as viewed in the rotational direction of the developing roller. For this reason, the carrier hardly scatters although the cleaning electric field is large.

Since the cleaning electric field is large, a time lag is easy to occur when the toner on the second developing roller migrates to the photosensitive members at the back end of the image as viewed in the rotational direction of the second developing roller. The back end of the image as viewed in the rotational direction of the second developing roller has sufficiently be developed with toner at the time of the first development since the back end of the image corresponds to the fore end of the image as viewed in the rotational direction of the first developing roller.

By the operation mentioned above, the resultant image is good in quality without the image defect.

Specifically, to suppress the fog, developing bias potential Vb1d is preferably selected to be −450V or lower when Vo is −600V. The following facts were confirmed by the experiment: Vb1 maybe increased up to about −580V (a difference between it and the background potential, 20V) for V0–600V, and the fog may be put within a tolerable level. In this case, as Vb1 is closer to V0, the developing electric field is more increased. However, an excessive amount of toner for development will lead to the deterioration of the gradation. Accordingly, it is actually determined allowing for the picture quality. The surplus development capability may be used for compensating for the deterioration of the development capability, caused by development deterioration by aging. Accordingly, the result image is stable against the aging.

As described above, the developing unit includes two developing rollers whose rotational directions are opposite to each other. In the developing unit, the bias voltage Vb1 of the developing roller (first developing roller) located upstream as viewed in the rotational direction of the photosensitive member is set at a potential, which is in value between the bias potential Vb1d of the developing roller (second developing roller) located downstream as viewed in the rotational direction of the photosensitive member and the background potential Therefore, the developing unit produces an image having a sufficient image density and less background fog, and are free from the back-end bleach and the image defect. Further, the developing unit has a sufficient capability to suppress the carrier scattering, when comparing with the conventional one. Accordingly, the carrier particles whose particle diameter is smaller than the conventional particle diameter selected within a range where the image defect caused by the carrier scattering does not occur, may be used in the developing unit of the invention. As a result, the high quality picture can be produced, and the developing system having a sufficient charging stability of the development is secured.

It is evident that substantially the same useful effect will be produced if the first developing roller is the forward turn developing roller and the second developing roller is the reverse turn developing roller.

SECOND EMBODIMENT

A second embodiment of the present invention will be described with reference to FIGS. 4 through 7C.

Figure 6A:
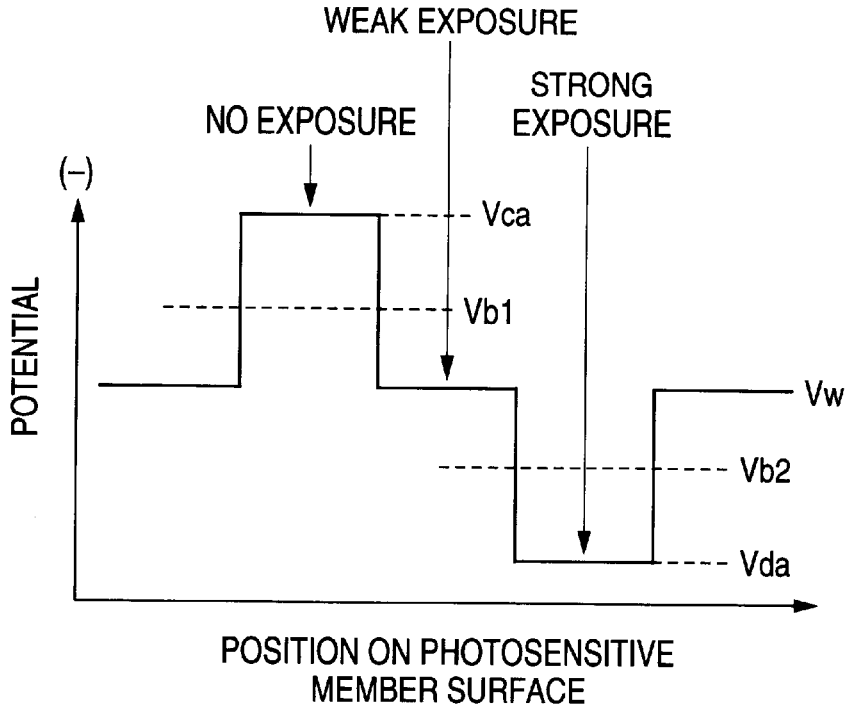
FIGS. 6A and 6B graphically represent a potential distribution and an electric field distribution with respect to positions on a photosensitive member surface after an exposure process is carried out.
Figure 6B:
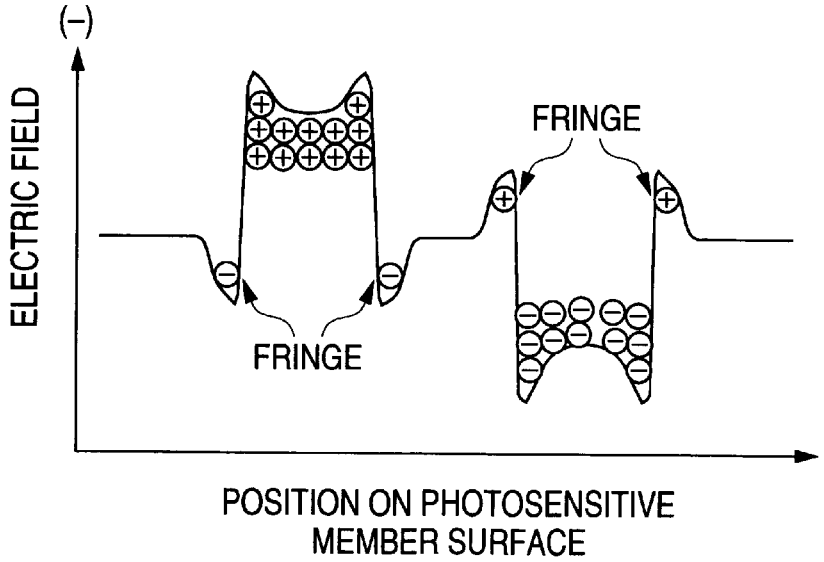

A mechanism to cause a fringe development in a two color image forming apparatus using the potential-dividing developing method will be described. FIGS. 6A and 6B graphically represent a potential distribution and an electric field distribution with respect to positions on a photosensitive member surface after an exposure process is carried out. The fringe development will be described with reference to FIGS. 6A and 6B. As shown in FIG. 6A, the surface potentials on the photosensitive member in the two-color image forming apparatus are: a location not exposed is at a charging potential Vca, a location weakly exposed is at charging potential Vw, and a location intensively exposed is at a discharging potential Image portion potential Vda. A charging potential portion at Qvca is developed with first toner by the developing unit applied with the developing bias voltage Vb1. The discharging potential portion at Vda is reverse developed with second toner by the developing unit applied with the developing bias voltage Vb2. The medium potential portion Vw is developed with neither of the first and second toner, and will be a white image. At the medium potential portions around the potential portions of Vca and Vda, a difference between each of Vca and Vda and the medium potential Vw is large. Accordingly, an electric field of the reverse direction is caused by the edge effect, and reversely charged toner attaches thereto. If the first toner is black in color and the second toner is red, a white portion around the black image is developed with the red toner and a white portion around the red image is developed with the black toner. The result image is formed as if the black image is fringed with red and the red image is fringed with black. In this sense, this development is called a "fringe development". Those colored fringes are those that should not be printed, and those are incorporated as erroneous print into the print result. That is, erroneous information is printed.

Figure 7A:
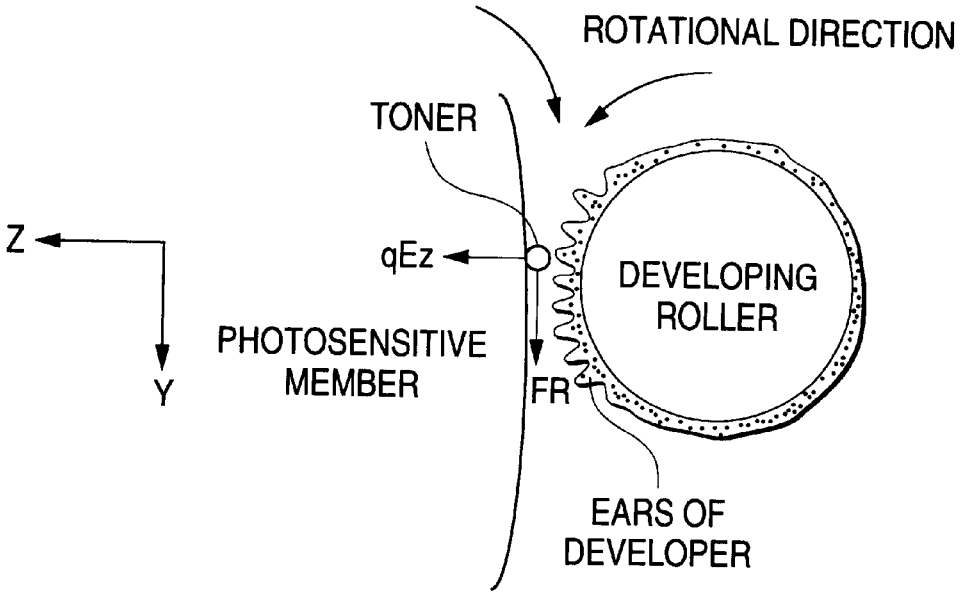
FIGS. 7A, 7B and 7C are diagrams for explaining a characteristic of a fringe phenomenon.
Figure 7B:
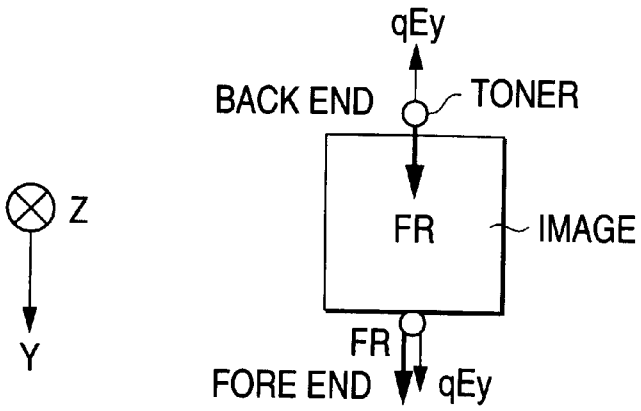

An intensity of the fringe changes depending on a relationship between the rotational directions of the photosensitive member and the developing roller at the developing portion, and the fore and back ends of the image. Fringe development characteristic and positions where it occurs will be described with reference to FIGS. 7A to 7C. FIG. 7A is a diagram showing a force acting on toner on the photosensitive member surface. Toner that is transported to the developing portion by the developing roller is transferred, for development, from the developing roller to the photosensitive member by a force qEz, which is represented by the product of an electric field Ez of the reverse direction caused by the edge effect around the image and a charge quantity "q" of the toner. Generally, a peripheral velocity of the surface of the developing roller is higher than that of the surface of the photosensitive member, to enhance the development capability. In the illustrated instance, the photosensitive member and the developing roller rotate in the same direction (forward rotation). Accordingly, a friction force FR by ears of the developer acts on the toner in positive direction of the Y directions as a result of a peripheral velocity difference between the photosensitive member and the developing roller. An electric field force qEy caused by an electric field Ey that is directed along the photosensitive member surface at the peripheral edge of the image portion also acts on the toner because of the potential difference between the image portion and the white portion therearound. When the image is at the discharging potential Vda, the electric field Ey is directed outwardly from the peripheral edge of the image. When it is at the charging potential Vca, the electric field Ey is directed inwardly from the peripheral edge of the image. The toner for the development by an electric field having the reverse direction, caused by the edge effect around the discharging potential Vda, has a positive charge quantity. The toner for the development by the electric field having the reverse direction, caused by the edge effect around the charging potential Vca has a negative charge quantity. Therefore, the force qEy acts on both the toner while directed outwardly from the peripheral edge of the image. FIG. 7B illustrates a force directed along the photosensitive member surface, which acts on the toner at the fore and back ends of the image as viewed in the rotational direction of the developing roller. As seen, a direction relationship between the friction force FR and the force qEy at the fore end of the image is different from that at the back end. At the front end of the image, the forces FR and qEy are directed in the same direction and remove the toner by the fringe development from the image edge. On the other hand, at the back end of the image, the forces FR and qEy are oppositely directed and the toner by the fringe development is stored in the image edge.

Figure 7C:
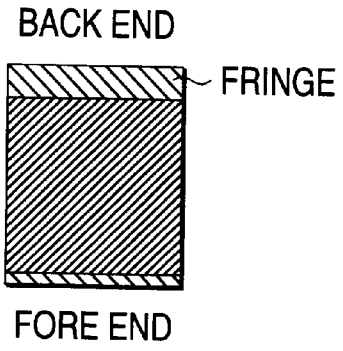

FIG. 7C illustrates a fringe which appears at the front end of the image as viewed in the rotational direction of the developing roller and a fringe which appears at the back end, which is different from the former. The fringe difference is due to the forces acting on the photosensitive member surface. As seen, the fringe at the back end of the image is more intensive than that at the fore end.

When a developing roller (reverse turn developing roll), which rotates in the direction reverse to the rotational direction of the photosensitive member, is used, the friction force FR by the ears of the developer acts in the negative direction of the Y directions, while it acts in the positive direction in the case of the forward turn developing roll. Accordingly, the fringe at the fore end of the image is more intensive than that at the back end.

A difference between the bias potential (Vb1 or Vb2) of the developing roller and the medium potential Vw is related to an intensity of the formed fringe in the following way. As the Vb1 and Vb2 are closer in value to the medium potential, the electric field having the reverse direction, caused by the edge effect (referred to as a fringe electric field) is more intensified. Accordingly, the fringe is intensively formed. As the Vb1 and Vb2 are more different in value from the medium potential, the fringe electric field is suppressed.

Figure 4:
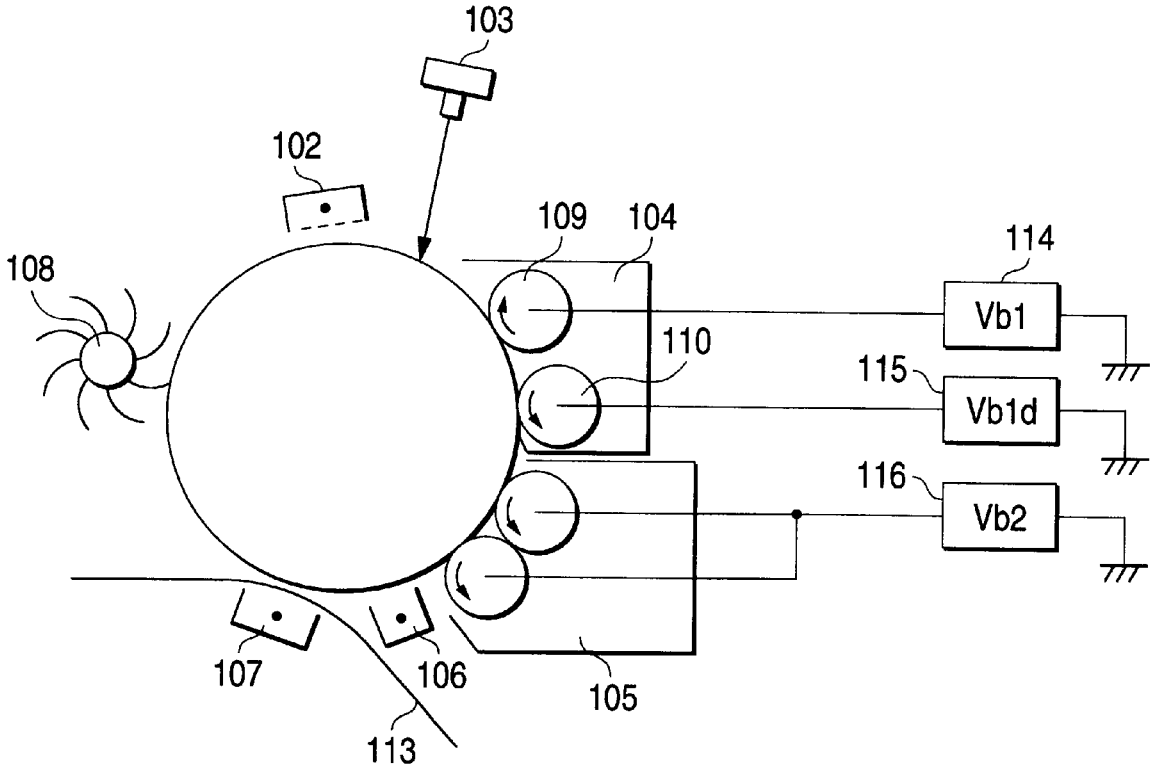
FIG. 4 is a diagram schematically showing a two-color image recording apparatus constructed according to the present invention.

FIG. 4 is a diagram schematically showing a two-color image recording apparatus using the potential-dividing developing method in which a reverse turn developing roller is used for the first developing roller in the first developing unit, and a forward turn developing roller is used for the second developing roller in the first developing unit. In the figure, reference numeral 101 is a photosensitive drum; 102 is a first charger; 103 is an exposure unit; 104 is a first developing unit; 105 is a second developing unit; 107 is a transfer unit; 108 is a cleaner; 109 is a reverse turn developing roller; 110 is a forward turn developing roller; 113 is a recording medium; and 114, 115 and 116 are power supplies.

Figure 5A:
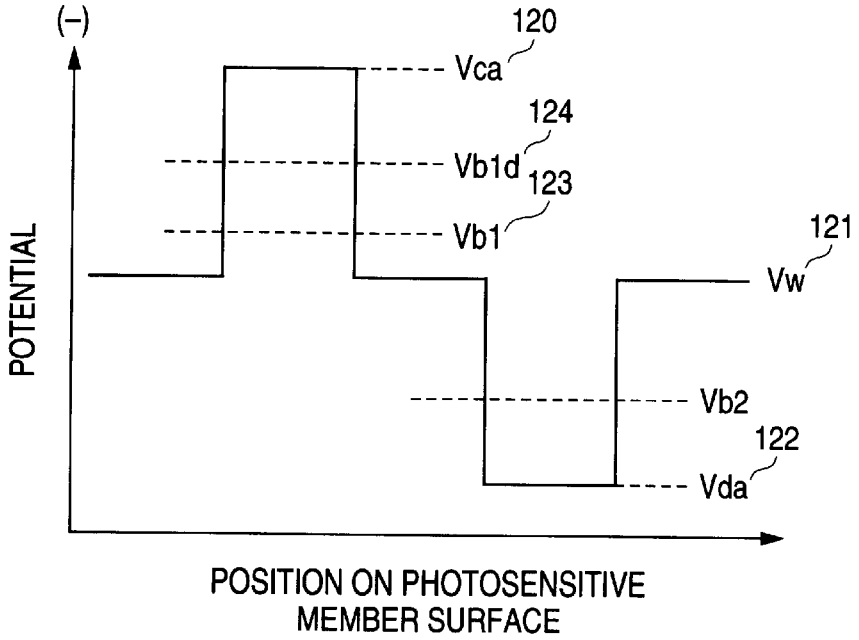
FIGS. 5*a* and 5*b* graphically represent a potential distribution on a photosensitive member and a model of development in a potential-dividing developing method.
Figure 5B:
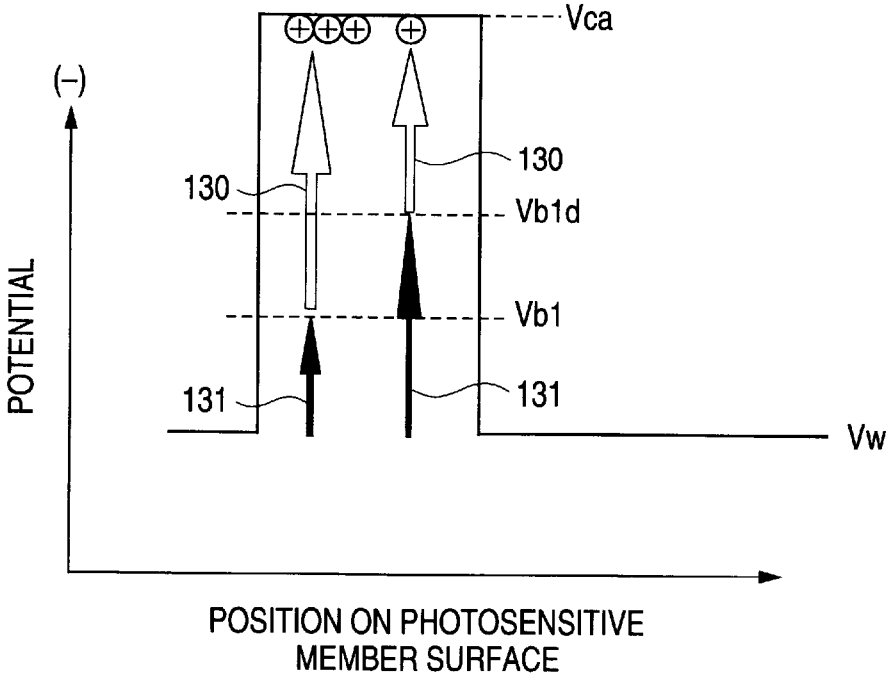

FIG. 5A is a diagram showing a relationship between a bias potential of the developing roller vs. potential distribution on the photosensitive member. FIG. 5B is a diagram showing a model of the operation at the developing portion in the first developing unit. In the figure, reference numeral 120 is a charging potential portion potential; 121 is a medium potential portion potential; 122 is a discharging potential portion potential; 123 is a bias potential for the reverse turn developing roller in the first developing unit; bias potential 124 is a bias potential for the forward turn developing roller in the first developing unit; 130 is a developing electric field for developing positively charged toner onto the Vca portion; and 131 is a cleaning electric field for gathering the positively charged toner from the Vw portion onto the developing roller.

In the two-color image forming apparatus of the invention shown in FIG. 4, a negatively charged OPC is used for the photosensitive drum 101. Positively charged toner is used for the first color toner, and negatively charged toner is used for the second color toner. The present invention is incorporated into the first developing unit. In FIG. 4, the photosensitive drum 101 rotates clockwise. The surface of the photosensitive drum 101 is uniformly and negatively charged by the first charger 102. A latent electrostatic image whose surface potential is in three levels Vca (120), Vw (121), and Vda (122) is formed on the photosensitive drum 101, through the exposing process by the exposure unit 103. Those surface potential levels are: Vca≈−800V, Vw≈−400V, and Vda≈−50V (FIG. 5A). Then, an image of the positively charged first toner is formed on a Vca portion on the photosensitive drum 101 by the reverse turn developing roller 109, which is biased at a developing bias potential Vb1 (about −450V) supplied from the power supply 114. Subsequently, an image of the positively charged first toner is superimposed on the Vca portion on the photosensitive drum 101 by the forward turn developing roller 110 in the first developing unit, which is biased at the developing bias potential Vb1a (about −150V) supplied from the power supply 115.

Then, an image of the negatively charged second toner is formed on the Vda portion on the photosensitive drum 101 by the second charger 106 biased at a developing bias potential Vb2 (−200V) supplied from the power supply 116.

A two-color toner image, which consists of the first and second toner images, is thus formed on the photosensitive drum 101, and is corona irradiated by the second charger 106, whereby the polarities of the toner image are arranged into a negative polarity. Thereafter, the two-color toner image is transferred onto a recording medium 113, e.g., paper, by the transfer unit 107, and then fixed thereon by a fixing unit (not shown). After the transfer process, the cleaner 108 wipes out the residual toner on the photosensitive drum 101, and the developing unit is ready for the next two-color image forming process.

A phenomenon occurring in the developing portion of the first developing unit will be described in detail with reference to FIG. 5B. When a latent electrostatic image formed on the photo sensitive member passes a developing portion by the reverse turn developing roller in the first developing unit, which is biased at the developing bias potential Vb1, a difference between Vb1 and charging potential Vca is large, but a difference between it and a white image potential Vw is small. As a result, a large developing electric field and a small cleaning electric field are developed. Therefore, the developing capability is good, and a high image density is secured. However, a called fog where weakly charged toner is attached to the medium potential portion occurs at many places. Further, since the difference between Vb1 and Vw is small, the fringe electric field is intensified and an intensive fringe occurs at the fore end of the image because the reverse turn developing roller is used.

Subsequently, when the latent electrostatic image passes a developing portion by the forward turn developing roller in the first developing unit, which is biased at the developing bias potential Vb1a, a difference between Vb1d and Vca is small, but a difference between it and medium potential Vw is large. As a result, a small developing electric field and a large cleaning electric field are generated. For this reason, the developing capability is relatively poor, but the large cleaning electric field gathers the weakly charged toner that was attached to the white potential portion by the reverse turn roll, onto the developing roller. Accordingly, the fog formed at the developing time by the reverse turn roll is removed. Further, since the developing roller and the photosensitive member rotate in the same direction, the fringe that was formed at the fore end of the image by the reverse turn roll is scrapped off. At this time, a fringe occurs anew at the rear end of the image in the developing portion by the forward turn developing roller. However, this fringe is suppressed since the difference between Vb1d and Vw is large and hence the fringe electric field is weak.

Vb1d is preferably −550V or higher for −400V of Vw in order to sufficiently suppress the fringe electric field. In this case, as Vb1 is closer to Vw, the developing electric field is more increased. In this respect, it is preferable that Vb1 is set at a value closest to Vw. The fog falls within the tolerable level till about −420V of Vb1d (20V as the difference between it and the white potential) for −400V of Vw. This was confirmed by our experiment.

As described above, the developing unit includes two developing rollers whose rotational directions are different a from each other, and a bias potential Vb1 of the developing roller (first developing roller) located upstream in the rotational direction of the photosensitive member is selected to be a potential, which is in value between a bias potential Vb1d of the developing roller (second developing roller) located downstream in the same direction and a medium potential. The developing unit is capable of producing an image having a high image density and less background fog, and are free from the fringe phenomenon. The above-mentioned unique construction likewise operates when it is applied to the second developing unit.

In the image forming apparatus of the second embodiment, the forward turn developing roller may be used for the first developing roller within the developing unit, and the reverse turn developing roller may be used for the second developing roller within the first developing unit. Also in this case, like useful effects are produced.

The fringe occurs only at the back end of the image at which the developing roller of the final stage within the developing unit comes in sliding contact with the photosensitive member. The invention may be combined with the auxiliary exposure method as disclosed JP-A-10-3957, in which when auxiliary light is irradiated onto an area in which the fringe development will occur, whereby the reverse electric field occurring thereat is suppressed in magnitude, and the fringe development is eliminated. By so doing, a developing process which can deal with a white potential variation by aging, with enough capability is secured.

As seen from the foregoing description, the image recording apparatus of the invention is capable of producing an image having a sufficient image density and less background fog, and are free from the back-end bleach and the image defect. A two-color image recording apparatus is capable of producing an image having a sufficient image density and less background fog, and are free from the fringe phenomenon.

What is claimed is:

1. An image forming apparatus comprising:

a photosensitive member rotating in a direction;

a charging unit for charging the photosensitive member;

an exposure unit for exposing the photosensitive member in accordance with image information to form a charging potential portion and a discharging potential portion on the photosensitive member; and a developing unit for developing the charging potential portion or the discharging potential portion using positively charged toner or negatively charged toner to form a toner image on the photosensitive member, the developing unit including:

a first developing roller located upstream in the rotational direction of the photosensitive member, the first developing roller rotating in a direction; and a second developing roller located downstream in the rotational direction of the photosensitive member, the second developing roller rotating in an opposite direction to the rotational direction of the first developing roller, wherein a bias potential of the first developing roller is set to a value between a bias potential of the second developing roller and a background potential.

2. The image forming apparatus according to claim 1, wherein the first developing roller rotates in the oposite direction to the rotational direction of the photosensitive member; and the second developing roller rotates in the same direction as the rotational direction of the photosensitive member.

3. The image forming apparatus according to claim 1, wherein auxiliary light is irradiated onto a portion at which a fringe phenomenon occurs to suppress a reverse electric field, whereby the fringe phenomenon is removed.

4. An image forming apparatus comprising:

a photosensitive member rotating in a direction;

a charging unit for charging the photosensitive member;

an exposure unit for exposing the photosensitive member, while changing an amount of exposing light, to form a charging potential portion, a discharging potential portion and an intermediate potential portion on the photosensitive member; and a developing unit for respectively developing the charging potential portion and the discharging potential portion using positively charged toner and negatively charged toner to form two different toner images on the photosensitive member, the developing unit including:

a first developing roller located upstream in the rotational direction of the photosensitive member, the first developing roller rotating in a direction; and a second developing roller located downstream in the rotational direction of the photosensitive member, the second developing roller rotating in an oposite direction to the rotational direction of the first developing roller, wherein a bias potential of the first developing roller is set to a value between a bias potential of the second developing roller and a potential of the intermediate potential portion.

5. The image forming apparatus according to claim 4, wherein the first developing roller rotates in the oposite direction to the rotational direction of the photosensitive member; and the second developing roller rotates in the same direction as the rotational direction of the photosensitive member.

6. The image forming apparatus according to claim 4, wherein auxiliary light is irradiated onto a portion at which a fringe phenomenon occurs to suppress a reverse electric field, whereby the fringe phenomenon is removed.

* * * * *